US008348359B2

(12) United States Patent
DeBoer et al.

(10) Patent No.: US 8,348,359 B2
(45) Date of Patent: Jan. 8, 2013

(54) RESISTANT SINK BASE CABINET

(75) Inventors: Jeff DeBoer, Ann Arbor, MI (US); Jim Stenz, Fenton, MI (US); Mike Nellenbach, Clawson, MI (US); Richard Ostrosky, Tecumseh, MI (US); Thomas John Linn, Adrian, MI (US); Dennis Hamilton, Adrian, MI (US); Mary Jo Mosiniak, Swanton, OH (US)

(73) Assignee: Masco Builder Cabinet Group, Adrian, MI (US)

( * ) Notice: Subject to any disclaimer, the term of this patent is extended or adjusted under 35 U.S.C. 154(b) by 445 days.

(21) Appl. No.: 12/649,488

(22) Filed: Dec. 30, 2009

(65) Prior Publication Data

US 2011/0156546 A1 Jun. 30, 2011

(51) Int. Cl.
*A47B 77/06* (2006.01)

(52) U.S. Cl. ..... 312/229; 312/228.1; 312/204; 312/244

(58) Field of Classification Search ..... 312/228, 312/228.1, 229, 204, 244, 257.1, 263, 265.5
See application file for complete search history.

(56) References Cited

U.S. PATENT DOCUMENTS

| | | | | |
|---|---|---|---|---|
| 2,146,939 | A | 2/1939 | Coordes | |
| 2,287,657 | A | 6/1942 | Wisckol | |
| 2,731,318 | A | 1/1956 | Hoff | |
| 3,653,532 | A | 4/1972 | Mann | |
| 1,394,238 | A | 5/1975 | Cole | |
| 4,098,545 | A | 7/1978 | Gaiser et al. | |
| 4,369,532 | A * | 1/1983 | Houchins et al. | 4/619 |
| 5,277,487 | A | 1/1994 | Simon | |
| 5,339,676 | A | 8/1994 | Johnson | |
| 5,368,379 | A | 11/1994 | Wrangberth | |
| 5,570,939 | A * | 11/1996 | Scott | 312/229 |
| 5,738,423 | A * | 4/1998 | Alfaro | 312/290 |
| 5,795,043 | A | 8/1998 | Johnson et al. | |
| 6,059,387 | A | 5/2000 | Echard et al. | |
| 6,364,440 | B2 | 4/2002 | Donahue | |
| 6,412,638 | B1 | 7/2002 | Carter | |
| 6,726,296 | B2 | 4/2004 | McGilton | |
| 7,731,309 | B2 * | 6/2010 | Gorini et al. | 312/228 |
| 7,748,798 | B2 * | 7/2010 | LeTourneau et al. | 312/258 |
| 2002/0023293 | A1 | 2/2002 | Lewis | |
| 2003/0032231 | A1 | 2/2003 | Efland et al. | |

(Continued)

FOREIGN PATENT DOCUMENTS

| | | |
|---|---|---|
| JP | 405095843 | 4/1993 |

(Continued)

*Primary Examiner* — Hanh V Tran
(74) *Attorney, Agent, or Firm* — Carlson, Gaskey & Olds PC

(57) ABSTRACT

A cabinet for use in an environment in which water may be present has a structural base and a face front. The structural base has a pair of structural plastic side pieces for bearing a load of the cabinet, the side pieces each have a pair of legs, a front edge, a back edge and a pair of mounting portions, a plastic floor the floor tilting downwardly from a back of the cabinet towards the face front, the plastic floor having a first portion attaching to one of the side pieces and a second portion for attaching to another of the side pieces, a pair of cross supports for connecting the structural sides above the plastic floor, the cross supports mounting within the mounting portions. The face front is made from wood or a wood byproduct and attaches to each side piece at the front edges thereof.

10 Claims, 2 Drawing Sheets

U.S. PATENT DOCUMENTS

| | | | | |
|---|---|---|---|---|
| 2003/0041373 | A1* | 3/2003 | Blazevich | 4/630 |
| 2004/0164658 | A1* | 8/2004 | Chen | 312/257.1 |
| 2005/0285487 | A1 | 12/2005 | Noh | |
| 2006/0186770 | A1* | 8/2006 | Lizell | 312/228.1 |
| 2009/0251035 | A1* | 10/2009 | Cash et al. | 312/265.5 |

FOREIGN PATENT DOCUMENTS

| | | |
|---|---|---|
| JP | 406217834 | 8/1994 |
| JP | 407163479 | 6/1995 |
| JP | 2000008437 | 1/2000 |
| JP | 2003116649 | 4/2003 |

* cited by examiner

RESISTANT SINK BASE CABINET

BACKGROUND OF THE INVENTION

Cabinets sold from shops or stores for installation by the purchaser are usually installed by holding the cabinet in an intended position against the wall and other cabinets while making or marking holes that are necessary to secure the cabinet in position. This is a difficult operation for the home handyman because of the weight and/or bulk of the cabinet. While supporting the cabinet it is often difficult to judge position and to free one hand to use a tool or marker. Irregular construction of the wall itself can add to these difficulties.

Cabinets that are sold in flat packs are sometimes difficult to assemble.

SUMMARY OF THE INVENTION

According to an exemplary embodiment, a cabinet for use in an environment in which water may be present has a structural base and a face front. The structural base has a pair of structural plastic side pieces for bearing a load of the cabinet, the side pieces each have a pair of legs, a front edge, a back edge and a pair of mounting portions, a plastic floor the floor tilting downwardly from a back of the cabinet towards the face front, the plastic floor having a first portion attaching to one of the side pieces and a second portion for attaching to another of the side pieces, a pair of cross supports for connecting the structural sides above the plastic floor, the cross supports mounting within the mounting portions. The face front is made from wood or a wood byproduct and attaches to each side piece at the front edges thereof.

According to another exemplary embodiment, a cabinet for use in an environment for which water may be present the cabinet has a face front and a base. The face front is made of a wood or wood byproduct and includes a frame and any combination of drawers or doors. The wood or wood byproduct gives a user an aesthetic impression that the entire cabinet is made of wood or wood byproducts. The cabinet base is attached to the face front and is made of a plastic to minimize the weight of the cabinet, to minimize damage caused by leakage and to eliminate food and an environment for insects or mold.

These and other features of the present invention can be best understood from the following specification and drawings, the following of which is a brief description.

DETAILED DESCRIPTION OF THE PREFERRED EMBODIMENT

Figure 1:
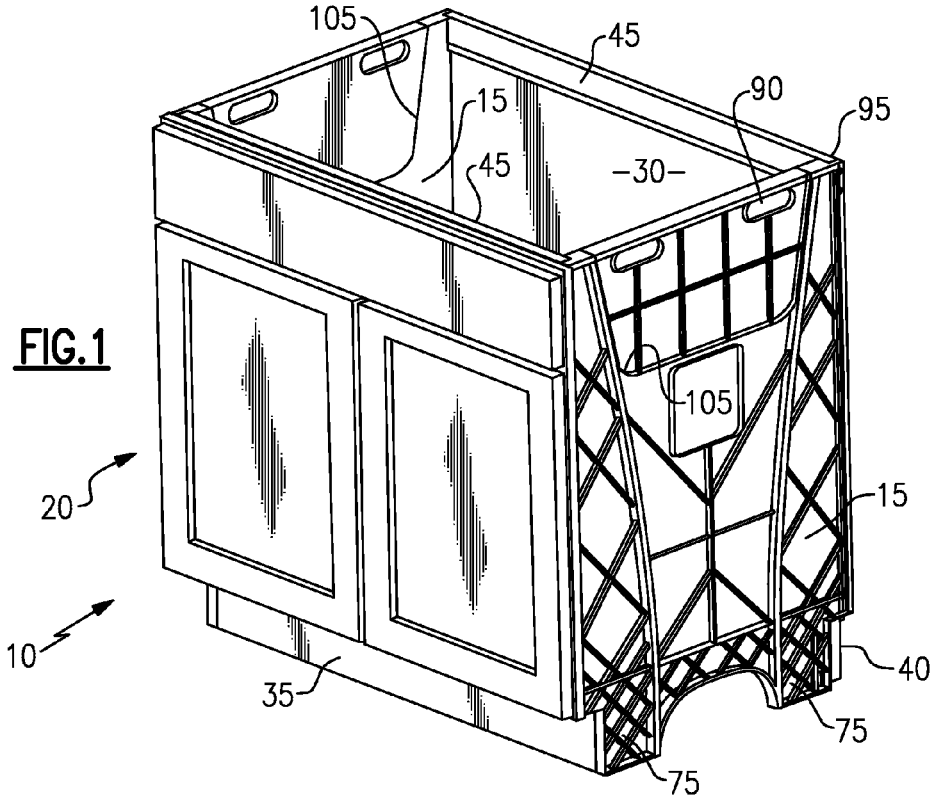
FIG. 1 is a perspective view of an embodiment of a cabinet disclosed herein.
Figure 2:
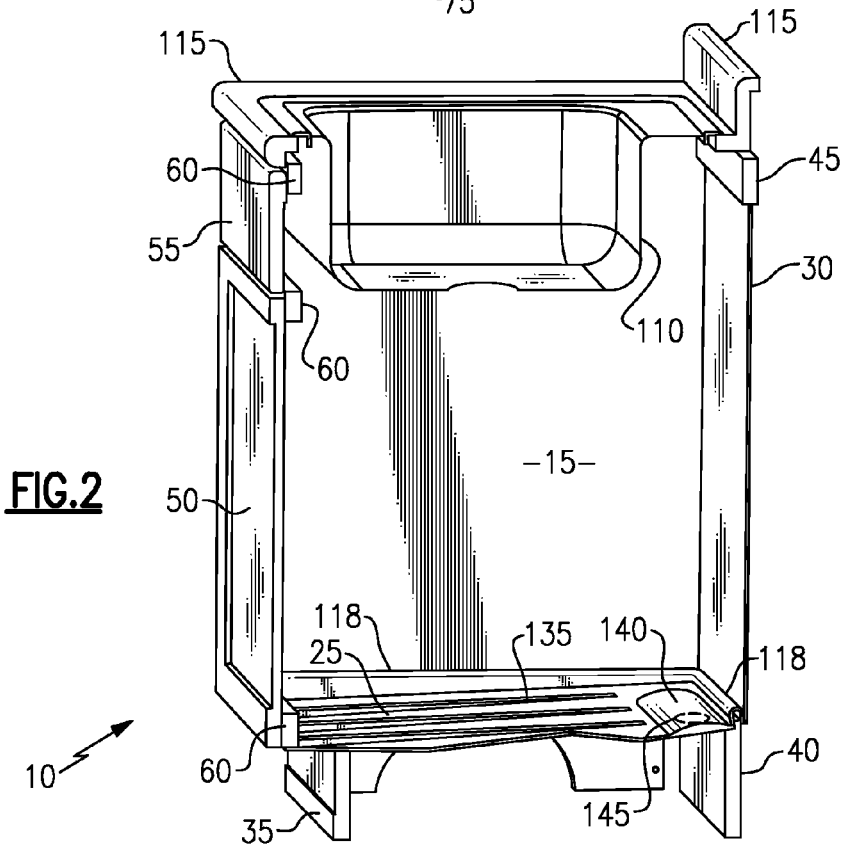
FIG. 2 is a side, cutaway view of the cabinet of FIG. 1.
Figure 3:
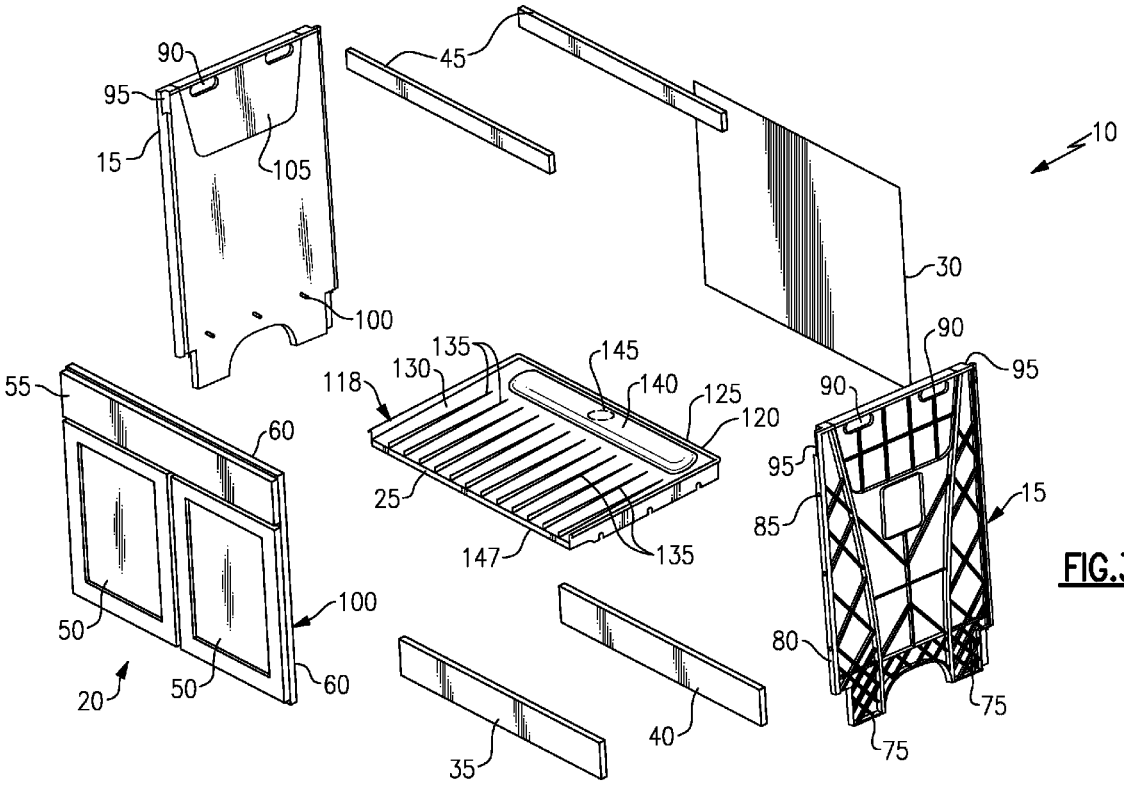
FIG. 3 is an exploded view of the cabinet of FIG. 1.

Referring to FIG. 1-3 an embodiment of a cabinet 10 is shown. The cabinet 10 has a pair of side pieces 15, a face front 20, a floor piece 25, a back panel 30, a kick plate 35, and a back support 40.

The face front 20 is comprised of a frame 60 that frames a pair of doors 50 and a faux drawer 55. The frame 60 sits on the floor piece 25.

Each side piece 15 has a pair of support legs 75, a pair of side portions 80 having attachment holes 85, a pair of hand holes 90 and a pair of notches 95 in which the top supports 45 are supported. Each side piece also has a plurality of pegs 100 extending therefrom for joining to the floor 25 piece as will be discussed herein (see FIG. 3).

Each side piece 15 also has a trapezoidal-shaped knockout portion 105 to fit a kitchen sink 110 (see FIG. 2) that is wider than the cabinet to be inserted therein. While removing the knockout portion the hand holes 90 will be removed but the structural strength of the side pieces 15 is not compromised. Each side piece has a plurality of raised portions that promote the strength of the cabinet and each side piece to support the face front and any item that might be placed on the cabinet like the sink 110 and molding 115 that is shown in FIG. 2.

The floor piece 25 has a rim 118 disposed around the perimeter of the floor piece except for the front of the floor upon which the frame 60 sits. The floor piece angles towards the face front 20 so that leakage upon the floor piece 25 flows through the face front 20. The floor panel also has a plurality of ribs 130 disposed there upon so that if water is disposed on the floor piece, any items in the cabinet such as soap or steel wool (not shown) will be disposed above the water by the ribs 130. The front and sides of the floor piece have a plurality of grooves disposed there around for mating with the pegs 100 in the sidewalls and in the frame 60. A raised area 140, which could also be a dome (not shown), is placed about a knockout area 145 (shown in phantom) through which a plumbing drain or water lines (not shown) may extend. By creating a raised area, the probability that water would fall down the hole in which plumbing extends is minimized to prevent damage in the subfloor or lower floors of the kitchen, bath or laundry room or the like (not shown).

To construct the cabinet, a user would separate the side pieces 15, place the floor piece upon the pegs 100 in each side piece 15, place the kick plate 35 against the legs 75, place the back support 40 along the legs 75 of each side pieces 15, place the top supports 45 in notches 95 in each of the side piece and anchor them thereto by a screw (not shown) or the like, attach the face front 20 to the side pieces 15 by lifting the face front under the floor piece 25 to cause the peg in the frame to join with the groove 135 in the front of the floor piece to center the face front and then drill through a connector like a screw through holes 85 into the frame 60 and drill through the top supports into the frame 60. The back piece 30 is also attached to the side pieces by attachments like screws (not shown) or the like.

The side pieces 15, the top supports 45 and the back panel 30, and the back support 40 are made of a water resistant, impervious, polymer such as a polyvinyl chloride ("PVC"). The face front 20 and the kick plate are standard wood, like maple or other real wood, or could be constructed of a medium density fiberboard ("MDF") that is coated or finished as is known in the art. The cabinet has standard dimensions as are known in the art. Other structural plastics beside PVC and other wood composites besides MDF are contemplated herein.

By using a normal face front with wood or MDF the aesthetics of the cabinet are maintained. By utilizing a plastic for the structure of the cabinet, wherever possible, the aesthetics of the cabinet are maintained while the weight of the cabinet is reduced by at least 20 percent. The hand holes 90 allow a worker to lug the cabinet into place more efficaciously. The knockout portions 105 makes it easy for a do it yourselfer to place and install an oversized sink in the cabinets. Use of the PVC or other structural plastic minimizes the presence of wood which may be a food source for mold. By minimizing the flow of water outside of the cabinet by the rim 118 and the raised portion 140, the flow of water, which is also required by mold and insects, is minimized to the substructure upon which the cabinet is mounted. By allowing leakage to flow out of the cabinet through the face front, a user is made aware of any leakage while minimizing damage to substructures. And because there are only a few simple parts, the cabinet is easy for a do it yourselfer to construct.

Although an embodiment of this invention has been disclosed, a worker of ordinary skill in this art would recognize that certain modifications would come within the scope of this invention. For that reason, the following claims should be studied to determine the true scope and content of this invention.

What is claimed is:

1. A cabinet for use in an environment in which water is present comprising;

a structural base, said base including:

a pair of structural, plastic side pieces for bearing a load of said cabinet, said side pieces each having a pair of legs, a front edge, a back edge and a pair of mounting portions, an impervious plastic floor said floor having a back and a floor front, said floor tilting and extending downwardly from said back to said floor front, said impervious floor having a first portion attaching to one of said side pieces and a second portion attaching to the other of said side pieces, a pair of cross supports for connecting said structural sides above said impervious floor, said cross supports mounting within said mounting portions, a face front made from wood or a wood byproduct, said face front attaching to each side piece at said front edges thereof and to said floor at said floor front and wooden doors attaching to said face front; wherein each of said side pieces further comprises a knockout portion that may be removed if an oversized sink is to be installed on top of said cabinet.

2. The cabinet of claim 1 wherein said impervious floor has a raised area through which plumbing is to be disposed therethrough such that leakage from said plumbing tends to flow down said raised area onto said impervious floor.

3. The cabinet of claim 1 further comprising;

a kickplate constructed of a wood or wood byproduct for attaching to a leg of each said side piece.

4. The cabinet of claim 3 further comprising an impervious support attaching to each of the other of said legs of said side piece.

5. The cabinet of claim 1 further comprising an impervious plastic back piece attaching to said back edge of each of said side pieces.

6. The cabinet of claim 1 wherein each of said side pieces further comprises a hand hold disposed in an upper surface thereof for carrying said cabinets.

7. The cabinet of claim 1 wherein a hand hold is disposed within said knockout portion.

8. The cabinet of claim 1 wherein said impervious floor has a rim disposed around a portion thereof for minimizing water flow over said impervious floor wherein said rim does not extend around a front of said cabinet to allow leakage to flow through a front of said cabinet along said frame.

9. The cabinet of claim 1 wherein said floor having a rim disposed around a portion thereof for minimizing water flow over said floor wherein said rim does not extend around a front of said cabinet to allow leakage to flow through a front of said cabinet.

10. The cabinet of claim 1 wherein said floor has no drain.

* * * * *